US007241947B2

(12) United States Patent
Kobayashi

(10) Patent No.: US 7,241,947 B2
(45) Date of Patent: Jul. 10, 2007

(54) SINGING VOICE SYNTHESIZING METHOD AND APPARATUS, PROGRAM, RECORDING MEDIUM AND ROBOT APPARATUS

(75) Inventor: Kenichiro Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 263 days.

(21) Appl. No.: 10/801,682

(22) Filed: Mar. 17, 2004

(65) Prior Publication Data

US 2004/0243413 A1 Dec. 2, 2004

(30) Foreign Application Priority Data

Mar. 20, 2003 (JP) ..... 2003-079149

(51) Int. Cl.
*G10H 7/00* (2006.01)

(52) U.S. Cl. ..... 84/645; 704/268

(58) Field of Classification Search ..... 704/268; 84/645

See application file for complete search history.

(56) References Cited

U.S. PATENT DOCUMENTS 4,527,274 A * 7/1985 Gaynor ..... 704/267
5,235,124 A * 8/1993 Okamura et al. ..... 434/307 A
5,642,470 A * 6/1997 Yamamoto et al. ..... 704/270
5,998,725 A * 12/1999 Ohta ..... 84/627
6,304,846 B1 * 10/2001 George et al. ..... 704/270
6,424,944 B1 * 7/2002 Hikawa ..... 704/260

FOREIGN PATENT DOCUMENTS

| | | |
|---|---|---|
| JP | 2001-179667 | 7/2001 |
| JP | 2001-188553 | 7/2001 |
| JP | 2002-258886 | 9/2002 |
| JP | 2002-268663 | 9/2002 |
| JP | 2002-268699 | 9/2002 |
| JP | 2002-304187 | 10/2002 |
| JP | 2002-311979 | 10/2002 |
| JP | 2002-311981 | 10/2002 |

* cited by examiner

*Primary Examiner*—Jeffrey W Donels
(74) *Attorney, Agent, or Firm*—Oblon, Spivak, McClelland, Maier & Neustadt, P.C.

(57) ABSTRACT

A singing voice synthesizing method and a singing voice synthesizing apparatus in which the singing voice is synthesized using performance data such as MIDI data. The performance data entered is analyzed as the musical information of the sound pitch, sound duration and the lyric (S2, S3). From the analyzed music information, the lyric is accorded to a string of sounds to form singing voice data (S5). Before delivering the singing voice data to a speech synthesizer, the sound range of the singing voice data is compared to the sound range of the speech synthesizer, and the key of the signing voice data and the performance data is changed so that the singing voice will be comprised within the sound range of the speech synthesizer (S9 to S12 and S14). A program, a recording medium and a robot apparatus, in which the singing voice is synthesized from performance data, are also disclosed.

22 Claims, 8 Drawing Sheets

| Track | Channel | Time | Type | Pitch | Duration | Velocity | Duration | Control type |
|---|---|---|---|---|---|---|---|---|
| | | | ⋮ | | | | | |
| 1 | 1 | 5:03:480 | control | – | – | – | – | Vibrato (depth 64, width 64, lag 50) |
| 1 | 1 | 5:03:480 | note | G4 | 199 | 100 | あ | |
| 1 | 1 | 5:04:000 | note | F#4 | 439 | 108 | る | |
| 1 | 1 | 5:04:480 | note | G4 | 199 | 100 | う | |
| 1 | 1 | 6:01:000 | note | E4 | 199 | 90 | ひ | |
| 2 | 1 | 4:01:480 | control | – | – | – | – | Expression (110) |
| 2 | 1 | 4:01:480 | control | – | – | – | – | Vibrato (depth 64, width 64, lag 50) |
| 2 | 1 | 6:01:480 | note | G3 | 199 | 100 | あ | |
| 2 | 1 | 6:02:000 | note | F#3 | 439 | 108 | る | |
| 2 | 1 | 6:02:480 | note | G3 | 199 | 100 | う | |
| 2 | 1 | 6:03:000 | note | E3 | 199 | 90 | ひ | |
| | | | ⋮ | | | | | |

FIG.2

| | |
|---|---|
| ¥song¥ | ← beginning of singing voice data |
| ¥PP,T10673075¥ | ← pause of 10673075 μsec |
| ¥tdyna 110 649075¥ | ← entire velocity during 10673075 μsec from leading end |
| ¥fine-100¥ | ← fine pitch adjustment (same as fine tune of MIDI) |
| ¥vibrato NRPN_dep=64¥ | ← vibrato |
| ¥vibrato NRPN_del=50¥ | |
| ¥vibrato NRPN_rat=64¥ | |
| ¥dyna 100¥ | ← relative strength from sound to sound |
| ¥G4,T288461¥あ | ← G4 pitch sound with duration of 288461 μsec, lyric being 'あ' |
| ¥dyna 108¥ | |
| ¥Gb4,T288462¥る | |
| ¥dyna 100¥ | |
| ¥G4,T288461¥う | |
| ¥dyna 90¥ | |
| ¥E4,T219592¥ひ | |
| ¥PP,T1222716¥ | |
| ¥dyna 100¥ | |
| ¥E4,T144231¥も | |
| ¥dyna 98¥ | |
| ¥E4,T144230¥り | |
| ⋮ | |

FIG.3

SINGING VOICE SYNTHESIZING METHOD AND APPARATUS, PROGRAM, RECORDING MEDIUM AND ROBOT APPARATUS

BACKGROUND OF THE INVENTION

1. Field of the Invention

This invention relates to a singing voice synthesizing method, a singing voice synthesizing apparatus, a program, a recording medium and a robot apparatus, in which the singing voice is synthesized from performance data.

This application claims the priority of the Japanese Patent Application No. 2003-079149 filed on Mar. 20, 2003, the entirety of which is incorporated by reference herein.

2. Description of Related Art

The technique for synthesizing the singing voice from given singing data by e.g. a computer is already known, as seen in Cited Patent Publication 1.

The MIDI (musical instrument digital interface) data is representative performance data and is a de-facto standard in the relevant business circles. Typically, the MIDI data is used for generating the musical sound by controlling a digital sound source termed a MIDI sound source (sound source actuated by MIDI data, such as a computer sound source or a sound source of an electronic musical instrument). A MIDI file, such as SMF (standard MIDI file), into which can be introduced lyric data, can be used for automatically formulating a music score with the lyric.

An attempt to exploit the MIDI data as parametric representations (special data representations) of the singing voice or the phoneme segments making up the singing voice has also been proposed, as may be seen in the Cited Patent Publication 2.

Although attempts were made in these conventional techniques to express the singing voice within the data format of the MIDI data, these attempts were made after all with the sense of controlling musical instruments.

Moreover, the MIDI data, prepared for other musical instruments, could not be changed to the singing voice without corrections.

The speech synthesizing software, which reads an E-mail or a home page aloud, is being put to sale by many producers, including 'Simple Speech' manufactured and sold by SONY CORPORATION. However, the manner of reading aloud is in no way different from the manner of reading an ordinary text.

A mechanical apparatus for performing movements like those of the human being, using electrical or magnetic operations, is termed a "robot". The robot started to be used extensively towards the end of the sixties. Most of the robots used were industrial robots, aimed at automating the production or performing unmanned operations in plants.

In recent years, developments of utility robots, supporting the human life as a partner to the human being, that is, supporting the human activities in various aspects in our everyday life, such as in our living environment, are progressing. In distinction from the industrial robots, these utility robots have the ability of learning the methods of adapting themselves to the human being with different personalities or to the variable environments in the variable aspects of the living environments of the human beings. For example, pet type robots, simulating the bodily mechanism or movements of animals, such as quadruples, e.g. dogs or cats, or so-called humanoid robots, simulating the bodily mechanism or movements of the human being, walking on two legs, are already being put to practical use.

As compared to the industrial robots, these utility robots are capable of performing variable movements, with emphasis placed on entertainment properties, and hence are also termed entertainment robots. Some of these entertainment robots operate autonomously, responsive to the information from outside or to the inner states.

The artificial intelligence (AI), used in these autonomously operating robot apparatus, artificially realizes intellectual functions, such as inference or judgment, and moreover attempts to artificially realize the functions, such as feeling or instinct. Among the expression means for the artificial intelligence, including visual expression means and expression means by natural languages, there is also the speech, as one of the functions expressing the natural language.

Cited Patent Publication 1

Japanese Patent No. 3233036

Cited Patent Publication 2

Japanese Patent Application Laid-Open No. H11-95798

The above-described conventional speech synthesis technique utilizes data of special format. Or, even if the technique utilizes MIDI data, it cannot effectively exploit lyric data embedded therein, or sing aloud the MIDI data prepared for musical instruments.

SUMMARY OF THE INVENTION

In view of the above-depicted status of the art, it is an object of the present invention to provide a method and an apparatus for synthesizing the singing voice in which it is possible to synthesize the singing voice through utilization of the performance data, such as MIDI data.

It is another object of the present invention to provide a method and an apparatus for synthesizing the singing voice in which, in exploiting the performance data, such as MIDI data, it is possible to provide singing in agreement with the sound range of the synthesized voice used for the singing voice.

It is another object of the present invention to provide a program and a recording medium for having the computer realize the singing voice synthesizing function.

It is yet another object of the present invention to provide a robot apparatus capable of realizing the singing voice synthesizing function.

For accomplishing the above objects, the present invention provides a method for synthesizing the singing voice comprising an analyzing step of analyzing performance data forming a musical composition as the musical information of the pitch, duration and lyric, a singing voice generating step of generating the singing voice through a speech synthesizer based on the music information analyzed, and a key changing step of changing the key of the musical composition in generating the singing voice. The key changing step changes the key of the performance data, at the time of generation of the singing voice, so that the singing voice will be comprised within the sound range which can be reproduced by the speech synthesizer.

The 'key' means 'tone' as a term for music and is associated with the sort of the sound scale determined by the tonic position. Specifically, changing the key is tantamount to changing (shifting or moving) the sound pitch or frequency.

The present invention also provides an apparatus for synthesizing the singing voice comprising analyzing means for analyzing performance data forming a musical composition as the musical information of the pitch, duration and lyric, singing voice generating means for generating the singing voice through a speech synthesizer based on the music information analyzed, and key changing means for changing the key of the musical composition in generating the singing voice. The key changing means changes the key of the performance data, at the time of generation of the singing voice, so that the singing voice will be comprised within the sound range which can be reproduced by the speech synthesizer.

With this structure of the singing voice generating method and apparatus according to the present invention, it is possible to analyze the performance data forming the musical composition, to generate the singing voice information, based on the sound note information, derived from the lyric, sound pitch, sound duration and the velocity, obtained from the analyzed data, and to generate the singing voice on the basis of the singing voice information. Moreover, in order to take account of such a case in which the sound range of the performance data is not optimum for a speech synthesizer used for synthesizing the singing voice, the key of the performance data is changed in generating the singing voice, by the key changing function, so that the singing voice will be comprised within the sound range that allows the singing voice to be reproduced by the speech synthesizer, thus enabling the singing in the optimum sound range.

The performance data is desirably the performance data of the MIDI file, such as SMF.

In changing the key of the musical composition, the key changing step or means desirably adjusts the key of the musical composition so that the highlight portion of the musical composition will be optimum as the sound range of the speech synthesizer. For example, the key changing step or means deems a portion of the performance data in which appears the same phrase a plural number of times as being the highlight to detect the highlight portion. This highlight portion may also be commanded or set by an operator.

The sound range data specifying the sound range that may be synthesized by the speech synthesizer may be provided, such that the key changing step or means may change the key based on this sound range data. This sound range data may be commanded or set by the operator. In case the speech synthesizer is capable of synthesizing plural sorts of the voice, the sound range data are preferably provided for the different sorts of the voice of the speech synthesizer.

The best sound range data, indicating the sound range which allows the speech synthesizer to synthesize the singing voice with the finest voice as the singing voice, may be provided in place of or in combination with the sound range data indicating the possible range of synthesis by the speech synthesizer, in which the key changing step changes the key based on this best sound range data.

It may be instructed by the operator whether or not the key changing step or means is to change the key.

The program according to the present invention allows the computer to realize the singing voice synthesizing function of the present invention. The recording medium according to the present invention may be read by the computer having this program loaded thereon.

The present invention also provides an autonomous robot apparatus executing a movement based on the input information supplied, in which the apparatus comprises analyzing means for analyzing performance data forming a musical composition as the musical information of the pitch, duration and lyric, singing voice generating means for generating the singing voice through a speech synthesizer based on the music information analyzed, and key changing means for changing the key of the musical composition in generating the singing voice. The key changing means changes the key of the performance data, at the time of generation of the singing voice, so that the singing voice will be comprised within the sound range which can be reproduced by the speech synthesizer. This allows improving entertainment properties of the robot appreciably.

With the method and apparatus for synthesizing the singing voice, according to the present invention, in which performance data making up a musical composition is analyzed as the musical information of the sound pitch, sound duration and the lyric, the singing voice is generated through a speech synthesizer based on the music information thus analyzed, and in which the key of the musical composition is changed when generating the singing voice so that the singing voice will be comprised within the sound range that may be reproduced by the speech synthesizer, it is possible to provide the singing in a sound range in meeting with the sound range of the speech synthesizer. Hence, the singing voice may be reproduced, without adding any special information, in music formulation or reproduction in which the expression in the conventional practice is made solely with the sound by the musical instruments, so that musical expressions may be improved appreciably.

The program according to the present invention allows the computer to execute the singing voice synthesizing function of the present invention by a computer, while the recording medium according to the present invention may be read by a computer having the program loaded thereon.

With the program and the recording medium according to the present invention, in which performance data making up a musical composition is analyzed as the musical information of the sound pitch, sound duration and the lyric, the singing voice is generated through a speech synthesizer based on the music information analyzed, and in which the key of the musical composition is changed, when generating the singing voice, so that the singing voice will be comprised within the sound range that may be reproduced by the speech synthesizer, it is possible to provide the singing in a sound range in meeting with the sound range of the speech synthesizer. Hence, it is possible to provide the singing in a sound range in agreement with the sound range of the speech synthesizer.

The robot apparatus according to the present invention achieves the singing voice synthesizing function of the present invention. The robot apparatus of the present invention is an autonomous robot apparatus performing movements based on the supplied input information, in which input performance data making up a musical composition is analyzed as the musical information of the sound pitch, sound duration and the lyric, the singing voice is generated through a speech synthesizer based on the music information analyzed, and in which the key of the musical composition is changed when generating the singing voice so that the singing voice will be comprised within the sound range that may be reproduced by the speech synthesizer, thus providing the singing in a sound range in meeting with the sound range of the speech synthesizer. The result is that the ability of expressions and entertainment properties of the robot apparatus may be improved, while the relationship of the robot apparatus with the human being may become more amicable.

BRIEF DESCRIPTION OF THE DRAWINGS

FIG. 2 shows an example of the music score information of the results of analysis.

FIG. 3 shows an example of the lyric information.

DESCRIPTION OF PREFERRED EMBODIMENTS

Figure 1:
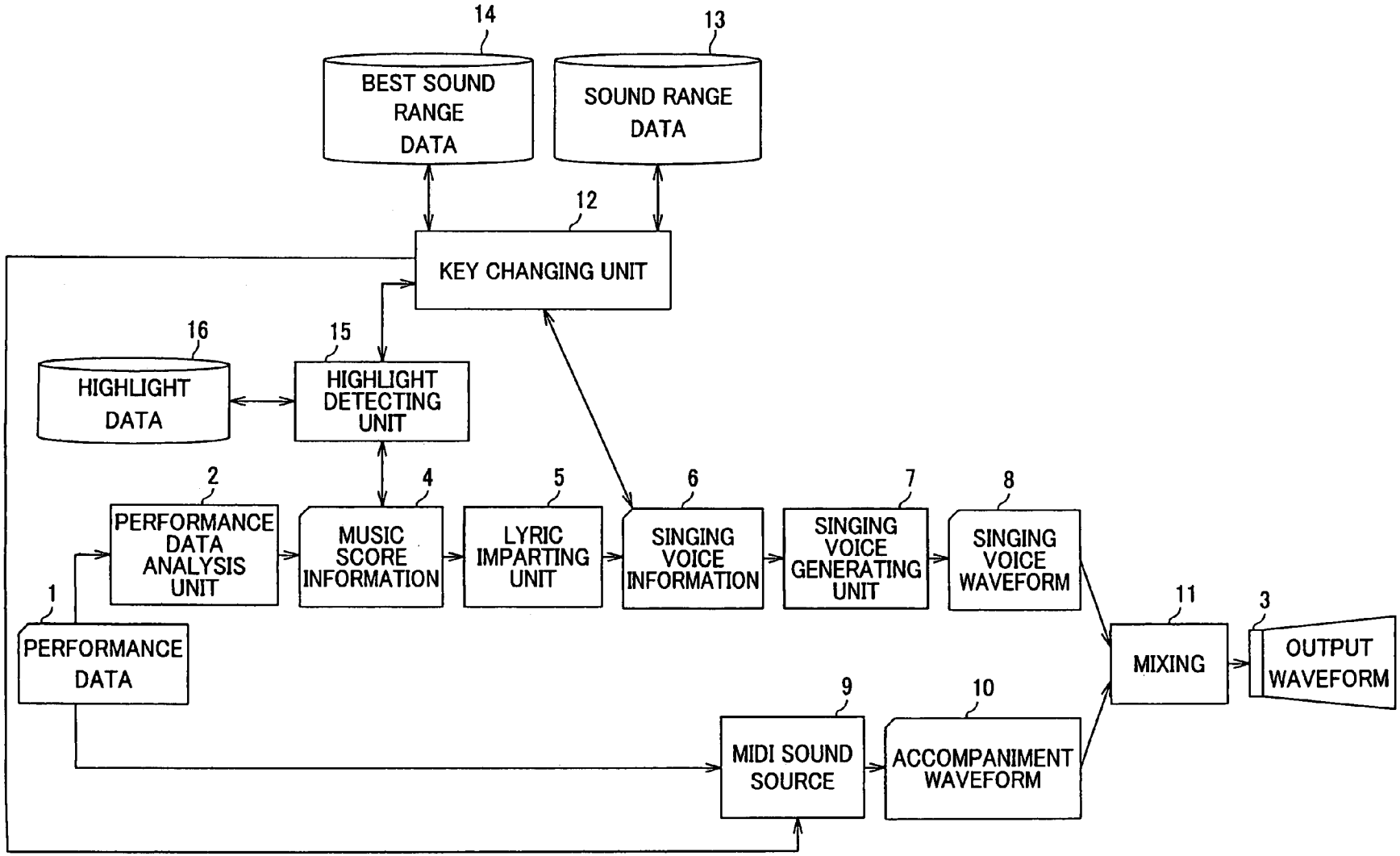
FIG. 1 is a block diagram for illustrating the system structure of a singing voice synthesizing apparatus embodying the present invention.

Referring to the drawings, specified embodiments of the present invention are now explained in detail.

FIG. 1 shows a schematic system structure of a singing voice synthesizing apparatus embodying the present invention. It should be noted that, although the singing voice synthesizing apparatus is presumed to be applied to for example a robot apparatus having at least a feeling model, a voice synthesis means and an uttering means, the singing voice synthesizing apparatus is not limited thereto and may naturally be applicable to a variety of robot apparatus and to a variety of computer AI (artificial intelligence).

In FIG. 1, a performance data analysis unit 2, configured for analyzing performance data 1, typified by the MIDI data, analyzes the input performance data 1 to convert the data into the music score information 4 representing the pitch, duration and the velocity of tracks or channels present in the performance data.

FIG. 2 shows examples of the performance data as converted to the music score information 4 (MIDI data). In FIG. 2, events are written with respect to each track and each channel. An event may be classified into a note event and a control event. The note event has the information of the time of occurrence (column 'time' in the drawing), pitch, duration and velocity. Hence, a string of notes or a string of sounds may be defined by a sequence of the note events. The control event has the information of the time point of occurrence, control type data (such as vibrato, performance dynamics expression) and data indicating the control contents. For example, in the case of the vibrato, the control contents include items of the 'depth' specifying the magnitude of the sound swing, the 'width' specifying the period of the sound shakiness, and the 'lag' specifying the start timing of the sound shakiness (time delay as from the uttering timing). The control event for the specified track or channel is applied to reproduction of the music sound of the track or channel in question unless a new control event (control change) for the control type occurs. In addition, the lyric may be entered on the track basis in the performance data of the MIDI file. In FIG. 2, 'あるうひ' ('one day', uttered as a-ru-u-hi'), shown in an upper portion, is part of the lyric entered in the track 1, while 'あるうひ' shown in a lower portion is part of the lyric entered in the track 2. That is, the example shown in FIG. 2, is one in which the lyric has been embedded in the analyzed music information (music score information).

Meanwhile, in FIG. 2, the time is represented by 'bar: beat: number of ticks', the duration is represented by 'the number of ticks', and the velocity is represented by numerical figures of '0 to 127'. As for the pitch, 440 Hz is represented by 'A4' and, as for the vibrato, the depth, width and the lag are represented by the numerical figures of '0-64-127'.

Returning to FIG. 1, the converted music score information 4 is delivered to a lyric imparting unit 5. The lyric imparting unit 5 generates, along with the information on e.g. the duration, pitch, velocity or expression of the sound corresponding to the notes, the singing voice information 6, provided with the lyric for the sound, based on the music score information 4.

FIG. 3 shows an example of the singing voice information 6. In FIG. 3, '¥song¥' is a tag indicating the start of the lyric information. A tag '¥PP, T10673075¥' indicates the pause of 10673075 μsec, a tag '¥tdyna 110 649075¥' indicates the overall velocity of 10673075 μsec as from the leading end, a tag '¥fine-100¥' indicates fine adjustment of the pitch equivalent to the fine tune of MIDI, and tags '¥vibrato NRPN_dep=64¥', '¥vibrato NRPN_del=50¥' and '¥vibrato NRPN_rat=64¥' denote the depth, lag and width of the vibrato, respectively. A tag '¥dyna 100¥' denotes the relative loudness of respective sounds, and a tag '¥G4, T288461¥あ' denotes the lyric element 'あ' (uttered as 'a') having a pitch of G4 and a duration of 288461 μsec. The singing voice information of FIG. 3 is obtained from the music score information shown in FIG. 2 (results of analysis of MIDI data). As may be seen from comparison of FIGS. 2 and 3, the performance data for controlling the musical instruments (e.g., musical note information) is sufficiently exploited in the generation of the singing voice information. For example, as regards the constituent element 'あ' in the lyric part 'あるうひ', the time of occurrence, duration, pitch and velocity contained in the control information or the note event information in the music score information (FIG. 2) are directly utilized in the lyric attribute other than 'あ', namely the time of occurrence, duration, pitch and velocity of the sound 'あ'. In the next lyric element 'る' (uttered as 'ru'), the next note event information in the same track and channel in the music score information is directly utilized, and so forth.

Returning to FIG. 1, the singing voice information 6 is delivered to a singing voice generating unit 7. This singing voice generating unit 7 forms a speech synthesizer. The singing voice generating unit 7 generates a waveform of the singing voice 8 based on the singing voice information 6. The singing voice generating unit 7, generating the waveform of the singing voice 8 from the singing voice information 6, is formed as shown for example in FIG. 4.

Figure 4:
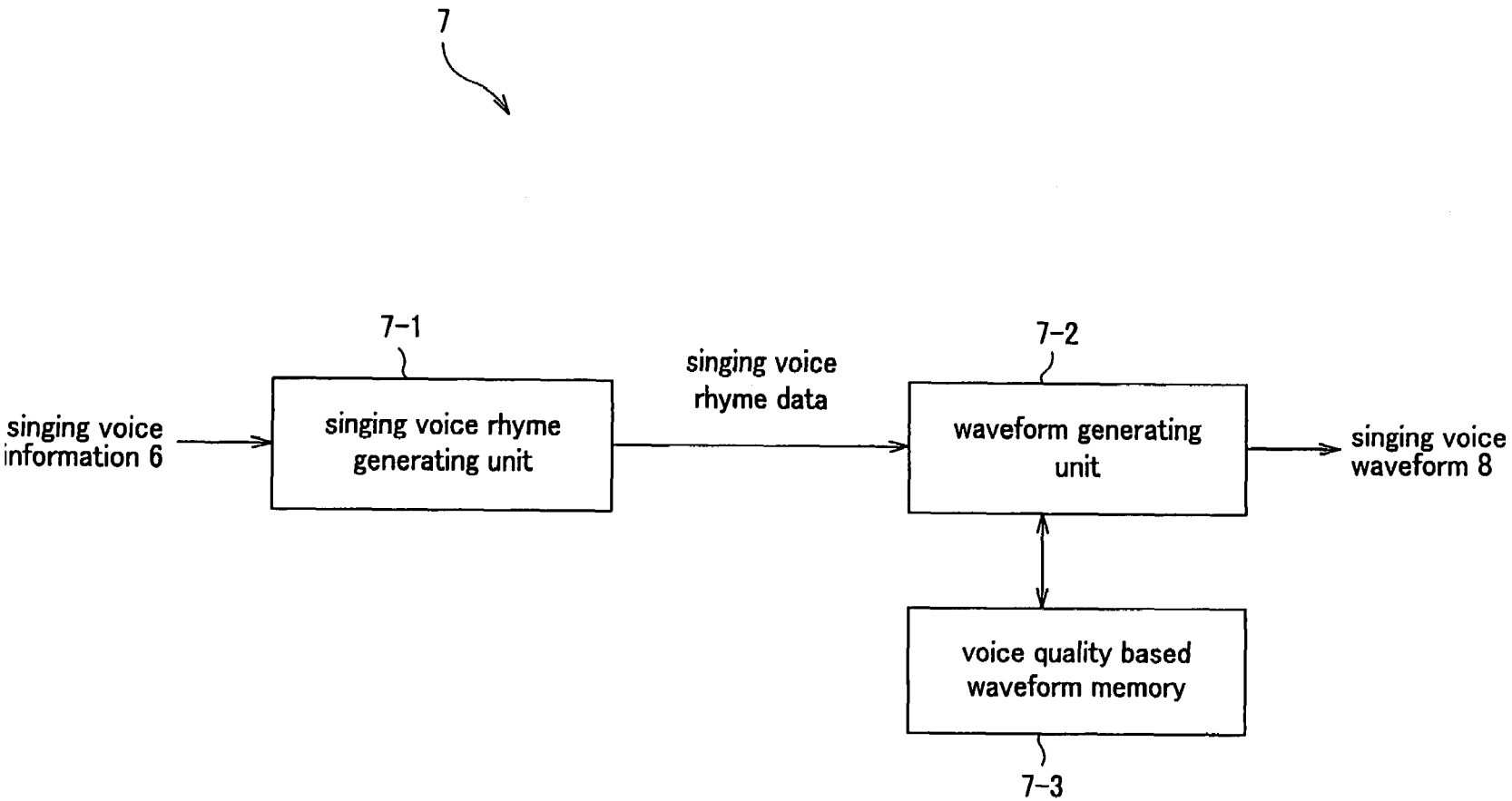
FIG. 4 is a block diagram showing an illustrative structure of a singing voice generating unit.

In FIG. 4, a singing voice rhyme generating unit 7-1 converts the singing voice information 6 into singing voice rhyme data. A waveform generating unit 7-2 converts the singing voice rhyme data into the waveform of the singing voice 8 through a voice quality based waveform memory 7-3.

As a concrete example, a case in which a lyric element 'ら' (uttered as 'ra') of the pitch of 'A4' is elongated a preset time length is explained. The singing voice rhyme data in case of not applying the vibrato are as shown in the following Table 1:

TABLE 1

| [LABEL] | | [PITCH] | | [VOLUME] | |
|---|---|---|---|---|---|
| 0 | ra | 0 | 50 | 0 | 66 |
| 1000 | aa | | | 39600 | 57 |
| 39600 | aa | | | 40100 | 48 |
| 40100 | aa | | | 40600 | 39 |
| 40600 | aa | | | 41100 | 30 |
| 41100 | aa | | | 41600 | 21 |
| 41600 | aa | | | 42100 | 12 |
| 42100 | aa | | | 42600 | 3 |
| 42600 | aa | | | | |
| 43100 | a. | | | | |

In the above Table, [LABEL] depicts the duration of each phoneme. That is, the phoneme 'ra' (phoneme segment) denotes the duration of 1000 samples from the sample 0 to the sample 1000, while the first phoneme 'aa' after 'ra' denotes the of 38600 samples from the sample 1000 to the sample 39600. The 'PITCH' denotes the pitch period by a dot pitch. That is, the pitch period at a sample 0 point is 56 samples. Since the pitch of 'ら' is not changed here, the pitch of 56 samples is applied to all samples. The 'VOLUME' denotes the sound volume at each sample point. That is, if the default is 100%, the sound volume at the sample 0 point is 66%, that at the sample 39600 point is 57%, the sample 40100 point is 48%, and so forth. The sound volume at the sample 42600 point is 3%. In this manner, attenuation of the voice 'ら' with lapse of time may be achieved.

If vibrato is applied, the following singing voice rhyme data, for example, is formed.

TABLE 2

| [LABEL] | | [PITCH] | | [VOLUME] | |
|---|---|---|---|---|---|
| 0 | ra | 0 | 50 | 0 | 66 |
| 1000 | aa | 1000 | 50 | 39600 | 57 |
| 11000 | aa | 2000 | 53 | 40100 | 48 |
| 21000 | aa | 4009 | 47 | 40600 | 39 |
| 31000 | aa | 6009 | 53 | 41100 | 30 |
| 39600 | aa | 8010 | 47 | 41600 | 21 |
| 40100 | aa | 10010 | 53 | 42100 | 12 |
| 40600 | aa | 12011 | 47 | 42600 | 3 |
| 41100 | aa | 14011 | 53 | | |
| 41600 | aa | 16022 | 47 | | |
| 42100 | aa | 18022 | 53 | | |
| 42600 | aa | 20031 | 47 | | |
| 43100 | a. | 22031 | 53 | | |
| | | 24042 | 47 | | |
| | | 26042 | 53 | | |
| | | 28045 | 47 | | |
| | | 30045 | 53 | | |
| | | 32051 | 47 | | |
| | | 34051 | 53 | | |
| | | 36062 | 47 | | |
| | | 38062 | 53 | | |
| | | 40074 | 47 | | |
| | | 42074 | 53 | | |
| | | 43100 | 50 | | |

As may be seen from the column [PITCH] of Table 2, the pitch period at sample 0 and sample 1000 points is the same and equal to 50 samples, such that there is no change in the voice pitch for this interval. Thereafter, the pitch period is swung up and down (50±3) with a period (width) of approximately 4000 samples, such as, for example, a 53 sample pitch period at a sample 2000 point, a 47 sample pitch period at a sample 4009 point, a 53 sample pitch period at a sample 6009 point, and so forth. This achieves the vibrato which is the shakiness of the voice pitch. The data of the column [PITCH] is generated on the basis of the information pertinent to for example the singing voice element (for example, 'ら', uttered as 'ra') in the singing voice information 6, in particular the note number, such as A4, and vibrato control data, for example, a tag '¥vibrato NRPN_dep=64¥', '¥vibrato NRPN_del=50¥' and '¥vibrato NRPN_rat=64¥'.

Based on these singing voice rhyme data, the waveform generating unit 7-2 reads out samples of the associated voice quality from the voice quality based waveform memory 7-3, adapted for storing phoneme segment data, on the sound quality basis, in order to generate the singing voice waveform 8. That is, the waveform generating unit 7-2 refers to the voice quality based waveform memory 7-3 and, based on the rhyme sequence, pitch period and the sound volume, indicated in the singing voice, retrieves closest phoneme segment data, to slice out and array these data, in order to generate speech waveform data. Specifically, the phoneme segment data are stored in the voice quality based waveform memory 7-3, on the voice quality basis, such as in the form of CV (consonants and vowels), VCV or CVC. Based on the singing voice rhyme data, the waveform generating unit 7-2 interconnects the needed phoneme segment data and adds pause, accents or intonation as necessary to generate the singing voice waveform 8. It should be noted that the singing voice generating unit 7 for generating the singing voice waveform 8 from the singing voice information 6 is not limited to that described above and any suitable known speech synthesizer may be used.

Returning to FIG. 1, the performance data 1 is delivered to a MIDI sound source 9, and MIDI sound source 9 then generates the music sound based on the performance data. This musical sound is an accompaniment waveform 10.

The singing voice waveform 8 and the accompaniment waveform 10 are delivered to a mixer 11 where the waveforms are synchronized and mixed to each other.

The mixer 11 synchronizes and overlays the singing voice waveform 8 and the accompaniment waveform 10 to each other and reproduces the synchronized and overlaid waveforms as an output waveform 3 to reproduce the music by the singing voice with the accompaniment, based on the performance data 1.

It should be noted that the singing voice information 6 does not necessarily have a suitable sound range for an output of the singing voice generating unit 7. In this consideration, the present embodiment provides a sound range of the singing voice generating unit 7, in which the voice as heard is finest, as a best sound range data 14, while providing sound range data 13, in which the sound may be generated as the singing voice. These data 13, 14 may be changed by a command from an operator.

The music score information 4, as analyzed, is delivered to the lyric imparting unit 5, at the same time as it is delivered to a highlight detecting unit 15.

Based on the music score information 4, the highlight detecting unit 15 verifies a portion of a musical composition, such as a vocal, where there appears a pattern of movements of the same notes (phrase) a plural number of times, as being the highlight portion in the musical composition to detect the highlight portion in the musical composition to store the portion as highlight data 16. The highlight data 16 indicates a sound range, such that, when a highlight musical composition portion is detected, the portion has the information on the highest sound and the lowest sound in the highlight portion. This highlight data 16 may be specified by an operator.

The singing voice information 6, generated by the lyric imparting unit 5, is delivered to a key changing unit 12, before being delivered to the singing voice generating unit 7. Initially, the key changing unit 12 refers to the highlight data 16 and, based on this highlight data 16, shifts the key of the singing voice information 6.

Specifically, the key changing unit 12 shifts the key, based on the best sound range data 14, so that the sound intermediate between the highest sound and the lowest sound of the highlight portion will be the same sound as the sound lying intermediate between the highest sound and the lowest sound of the best sound range data 14.

If, in finding the intermediate point, there are an even number of sounds in the sound range, the lower sound closest to the intermediate point is used as the sound of the intermediate point. For example, if the best sound range data 14 encompasses the sound range between C4 and C5, the intermediate sound is the F#4 sound, whereas, if the highlight information encompasses the sound range between G4 and D5, A#4 is the intermediate sound of the highlight data.

From these intermediate points, the key changing unit 12 verifies that the intermediate point A#4 of the highlight of the musical composition is higher by 2 w (corresponding to four semitones) than the intermediate point F#4 of the best sound range, and converts the key of the musical composition into the singing voice information 6 lower by 2 w. In this manner, the key is adjusted so that the sound range of the highlight of the musical composition will become the best sound range as the singing voice.

If the highlight is not specified, or if the highlight has not been detected by the highlight detecting unit 15, the highest sound and the lowest sound in the musical composition are generated as the highlight data.

If the highlight has not been detected, or is not specified, the key is changed, based on the highest sound and the lowest sound in the musical composition, in the same manner as when the highlight has been detected.

If the highlight data 16 exceeds the high side or the low side of the sound range specified by the best sound range data 14, the key is adjusted so that the highlight data will be comprised within the sound range data 13 representing the sound range possible as the singing voice. This adjustment is carried out in the similar manner to that described above by matching the intermediate points of the respective sound ranges.

In the case where the sound range of the highlight data 16 is not comprised within the sound range of the sound range data 13, despite the matching of the intermediate points, the sound range is lowered or raised by one octave when the sound range of the highlight data 16 exceeds the upper side or the lower side of the sound range of the sound range data 13, respectively. If there lacks the command for octave shifting, no octave shifting is performed.

The width of movement of the key, thus transposed, is delivered as the control information in reproducing the MIDI sound source 9. The key of the output of the MIDI, reproduced simultaneously as the singing voice, is also changed.

In the case where the singing voice generating unit 7 is a speech synthesizer capable of synthesizing plural voice sorts, the best sound range data 14 and the sound range data 13, representing the sound range possible as the singing voice, are provided for respective voice sorts.

It may be commanded by the operator whether or not the key is to be changed.

In the foregoing explanation, the lyric is contained in the performance data. However, this is not limitative of the present invention. If no lyric is contained in the performance data, any suitable lyric part, such as 'ら' (uttered as 'ra') or 'ぼん' (uttered as 'bon'), may be automatically generated or entered by an operator, and the lyric part, thus generated or entered, may be allocated to the performance data (tracks or channels), as the target of the lyric, as selected by the lyric imparting unit.

Figure 5:
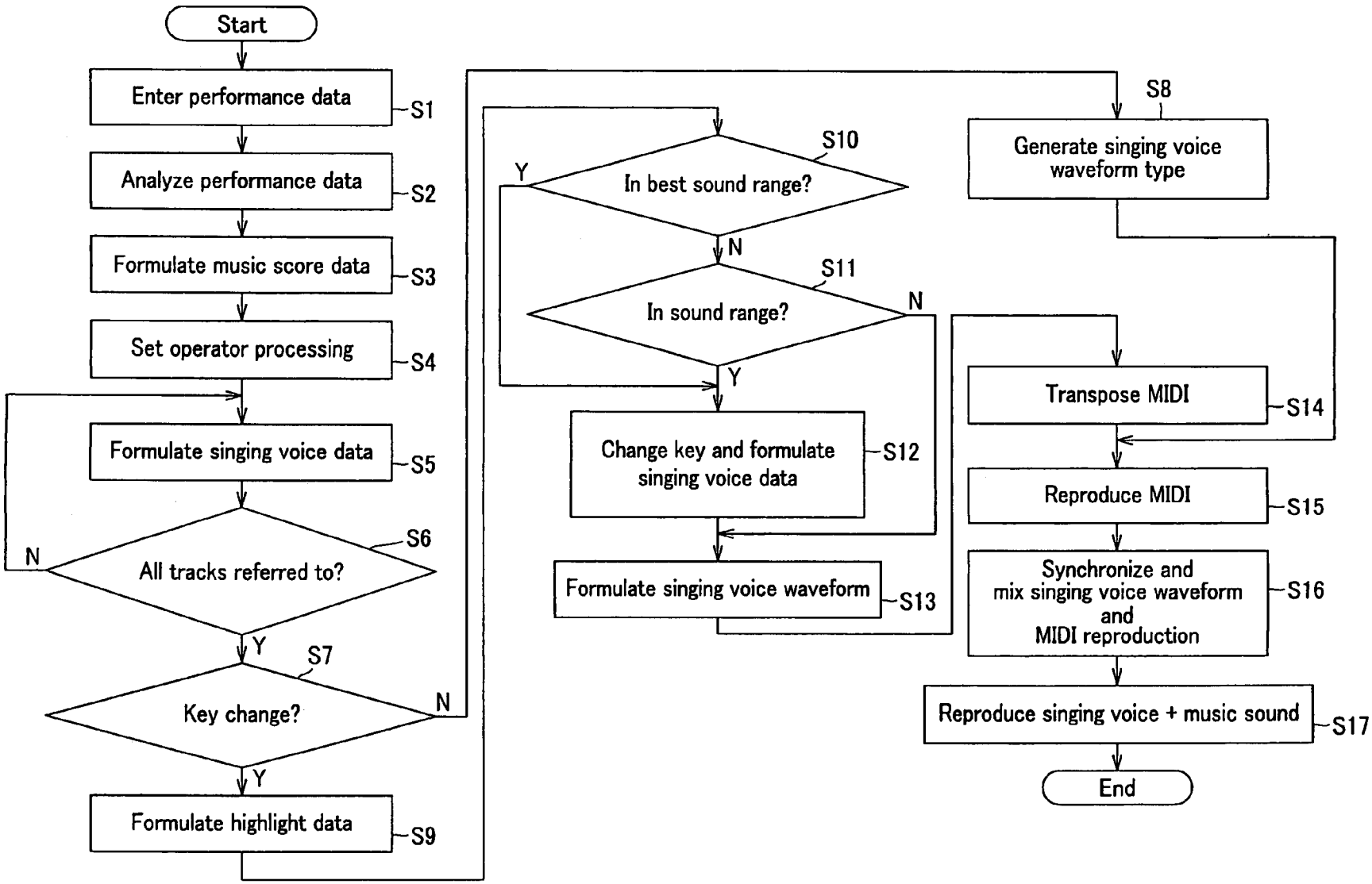
FIG. 5 is a flowchart for illustrating the operation of the singing voice synthesizing apparatus embodying the present invention.

FIG. 5 shows, as a flowchart, the overall operation of the singing voice synthesizing apparatus shown in FIG. 1

In FIG. 5, the performance data 1 of the MIDI file is first entered (step S1). The performance data 1 is then analyzed to prepare the music score information 4 (steps S2 and S3). An inquiry is then made of an operator who then performs setting operations (such as giving a command as to whether or not the key is to be changed, selecting the voice quality, setting the sound range data 13 or the best sound range data 14, or specifying the track to which is to be accorded the lyric) (step S4). Insofar as no setting has been made by the operator, default may be used in the subsequent processing.

The singing voice information 6 is then prepared by allocating the lyric to the performance data of the track or lyric, to which the lyric is applied, based on the formulated music score data (steps S5 and S6).

The key change command from the operator is then checked (step S7). Lacking the command, processing transfers to a step S8 to generate the voice waveform (singing voice waveform 8) without transposition. Should there be the key change command from the operator, processing transfers to a first step S9 of the transposition routine.

In the step S9, the highlight data is formulated. For example, (a1) an inquiry is made of the operator as to designation of a highlight portion. If there is the designation of the highlight portion, the highlight data is formulated in accordance with the designation. (a2) Lacking the designation of the highlight portion, the highlight detecting routine is carried out by the highlight detecting unit 15 in an attempt to detect the highlight portion, that is, a musical composition portion where there appears a pattern of movements of the same notes (phrase) a plural number of times. (a3) In the case where the highlight has been detected successfully, the highest sound and the lowest sound of the highlight are formulated as highlight data. (a4) In the case of failure in the highlight detection, the highest sound and the lowest sound of the singing voice information 6 are formulated as the highlight data.

In the next step S10, the best sound range data is checked. Specifically, (b1) a difference D between the intermediate sound P2 of the highlight data and the intermediate sound P1 of the best sound range data, for example, is found; (b2) it is checked whether the sound range of the highlight data shifted by the difference D is comprised within the sound range of the best sound range data; (b3) if the result of the check is affirmative, the difference D is delivered to a step S12 as being 'within the best sound range'; and (b4) if the result of the check is negative, processing transfers to a step S11 as 'the highlight data sound range not being within the best sound range'.

In a step S11, the sound range that may be used is checked. Specifically, (c1) a difference D between the intermediate sound P2 of the highlight data and the intermediate sound P1 of the sound range data, for example, is found; (c2) it is checked whether the sound range of the highlight data shifted by the difference D is comprised within the sound range of the sound range data; (b3) if the result of the check is affirmative, the difference D is delivered to a step S12 as being 'within the sound range'; and (b4) if the result of the check is negative, processing transfers to a waveform generating step S13, as the step S12 is skipped.

In the step S12, the note numbers of the sounds contained in the singing voice information 6 are shifted by D to change the key of the musical composition.

In the waveform generating step S13, the voice waveform of the singing voice is formed from the singing voice information 6, obtained by the processing, carried out so far, by the singing voice generating unit 7.

The note numbers of the sounds of the performance data 1 are shifted by the difference D to transpose the MIDI data to the same key as that of the singing voice.

After the steps S14 or S8, the MIDI is reproduced by the MIDI sound source 9 to formulate the accompaniment waveform 10 (step S15).

The processing carried out so far yields the singing voice waveform 8 and the accompaniment waveform 10.

The mixer 11 synchronizes and overlays the singing voice waveform 8 and the accompaniment waveform 10 to each other and reproduces the synchronized and overlaid waveforms as an output waveform 3 to reproduce the music (steps S16 and S17). The output waveform 3 is output via a sound system, not shown, as acoustic signals.

The above-depicted singing noise synthesizing function is loaded on, for example, a robot apparatus 60.

The robot apparatus of the type walking on two legs, now explained as an illustrative structure, is a utility robot for supporting the human activities in various aspects of our everyday life, such as in our living environment, and is an entertainment robot capable not only of acting responsive to the inner states (such as anger, sadness, happiness or pleasure) but also of representing the basic movements performed by the human beings.

Figure 6:
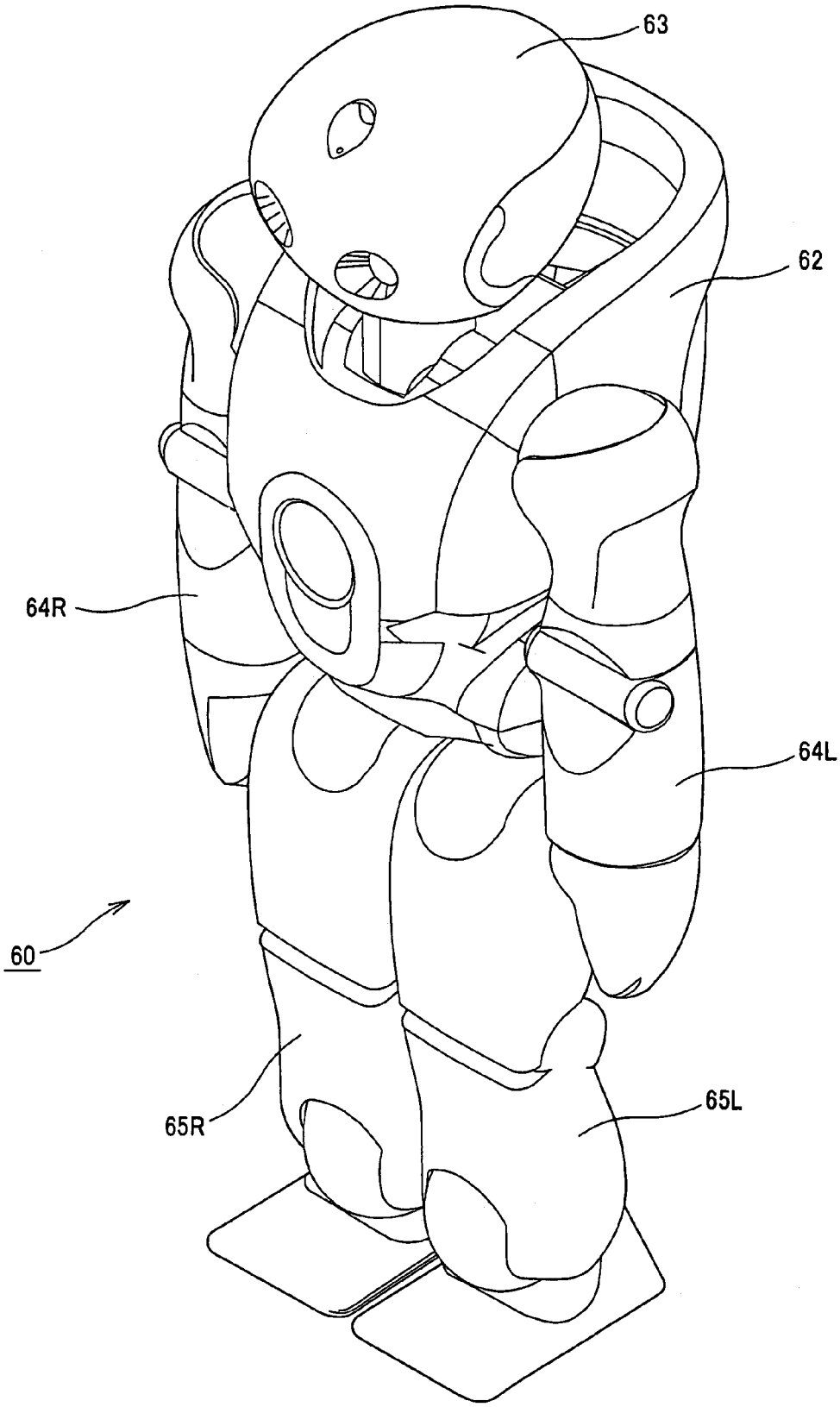
FIG. 6 is a perspective view showing the appearance of a robot apparatus embodying the present invention.

Referring to FIG. 6, the robot apparatus 60 includes a body trunk unit 62, a head unit 63, connected to preset locations of the body trunk unit 62, left and right arm units 64R/L and left and right leg units 65R/L also connected to preset locations of the body trunk unit. It should be noted that R and L are suffixes indicating right and left, respectively, as in the following.

Figure 7:
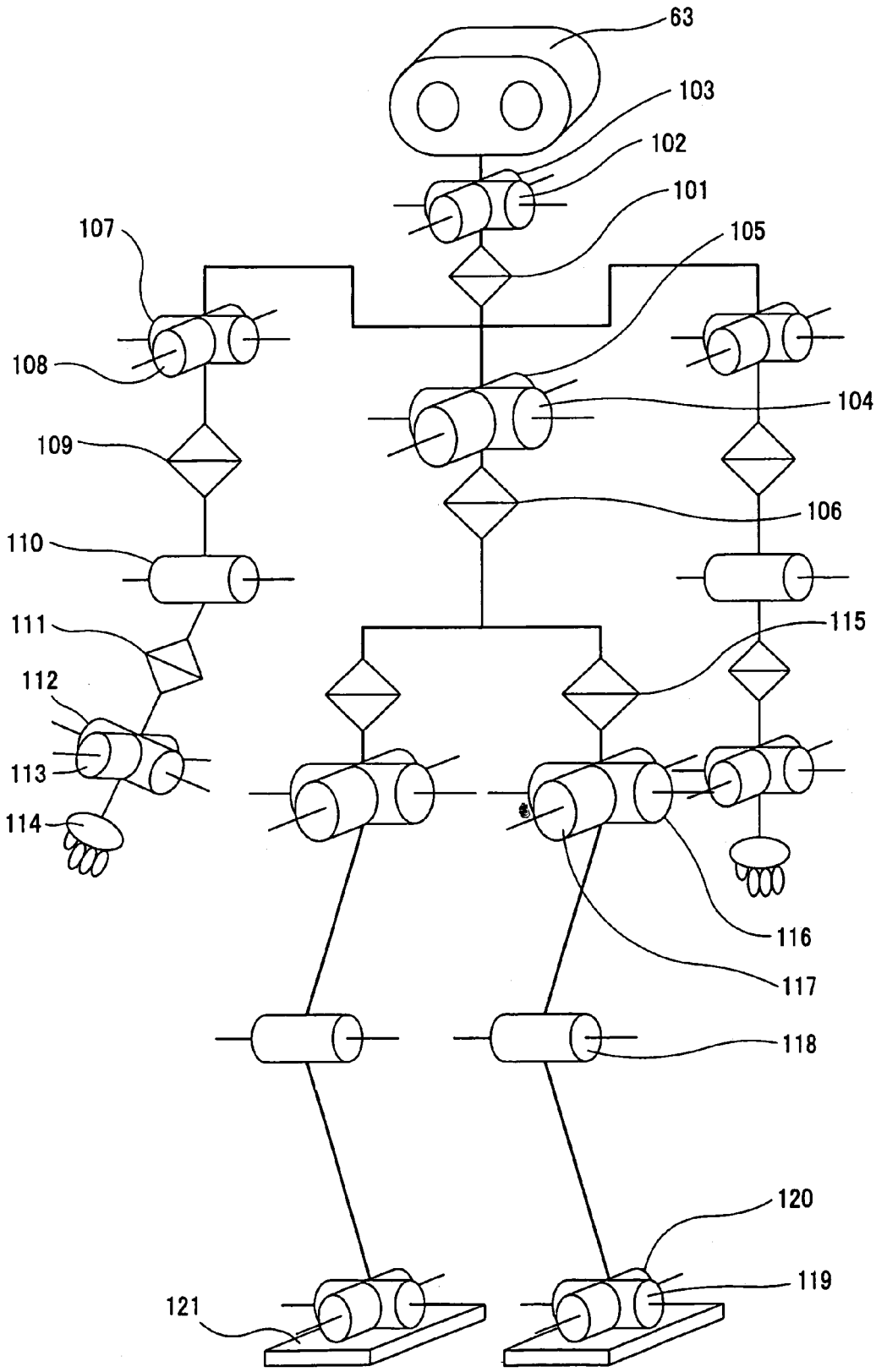
FIG. 7 schematically shows a freedom degree representing model of the robot apparatus.

FIG. 7 schematically shows the structure of the degrees of freedom provided to the robot apparatus 60. The neck joint, supporting the head unit 63, has three degrees of freedom, namely a neck joint yaw axis 101, a neck joint pitch axis 102 and a neck joint roll axis 103.

The arm units 64R/L, forming the upper limbs, are each made up by a shoulder joint pitch axis 107, a shoulder joint roll axis 108, an upper arm yaw axis 109, an elbow joint pitch axis 110, a forearm yaw axis 111, wrist joint pitch axis 112, a wrist joint roll axis 113 and a hand part 114. The hand part 114 is, in actuality, a multi-joint multi-freedom degree structure including plural fingers. However, the hand unit 114 is assumed herein to be of zero degree of freedom because it contributes to the posture control or walking control of the robot apparatus 60 only to a lesser extent. Hence, each arm unit is assumed to have seven degrees of freedom.

The body trunk unit 62 has three degrees of freedom, namely a body trunk pitch axis 104, a body trunk roll axis 105 and a body trunk yaw axis 106.

The leg units 65R/L, forming the lower limbs, are each made up by a hip joint yaw axis 115, a hip joint pitch axis 116, a hip joint roll axis 117, a knee joint pitch axis 118, an ankle joint pitch axis 119, an ankle joint roll axis 120, and a foot unit 121. The point of intersection of the hip joint pitch axis 116 and the hip joint roll axis 117 is defined herein as the hip joint position. The foot unit 121 of the human body is, in actuality, a structure including the multi-joint multi-degree of freedom foot sole. However, the foot sole of the robot apparatus 60 is assumed to be of the zero degree of freedom. Hence, each leg part is formed by six degrees of freedom.

To summarize, the robot apparatus 60 in its entirety has $3+7\times2+3+6\times2=32$ degrees of freedom. However, the robot apparatus 60 for entertainment is not necessarily restricted to 32 degrees of freedom, such that the degrees of freedom, that is, the number of joints, may be increased or decreased depending on constraint conditions imposed by designing or manufacture or requested design parameters.

In actuality, the degrees of freedom, provided to the robot apparatus 60, are mounted using an actuator. Because of the request for eliminating excessive swell in appearance to simulate the natural body shape of the human being, and for managing posture control for an instable structure imposed by walking on two legs, the actuator is desirably small-sized and lightweight. Additionally, the actuator is desirably constructed by a small-sized AC servo actuator of the direct gear coupling type provided with a one-chip servo control system loaded in the motor unit.

Figure 8:
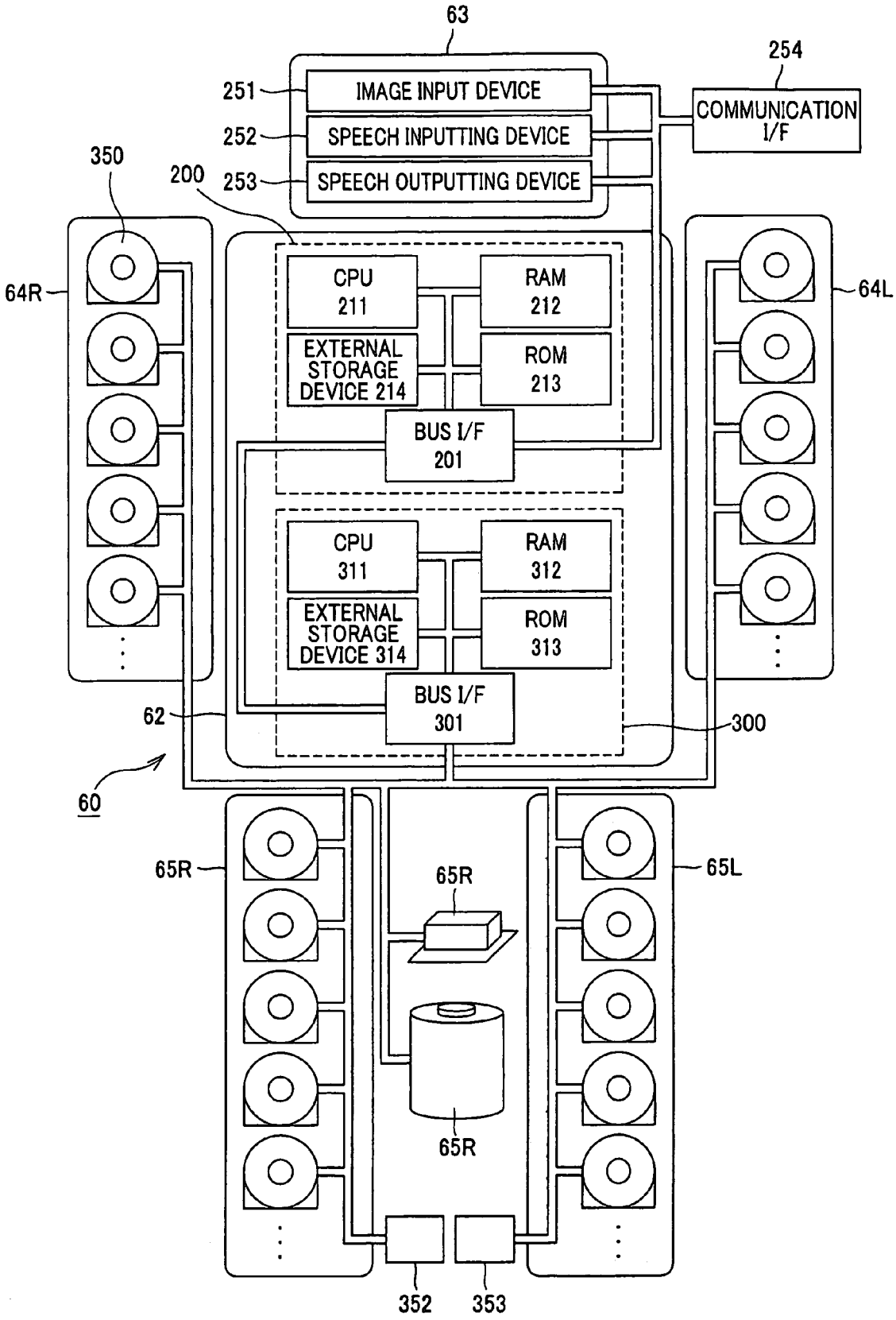
FIG. 8 is a block diagram showing the system structure of the robot apparatus.

FIG. 8 schematically shows a control system structure of the robot apparatus 60. Referring to FIG. 8, the control system is made up by a thinking control module 200 dynamically responding to e.g. a user input so as to be responsible for emotional judgment or feeling expression, and a motion control module 300 for controlling the whole-body concerted movement of the robot apparatus 60, such as the driving of an actuator 350.

The thinking control module 200, made up by a CPU (central processing unit) 211, executing calculations concerning the emotional judgment or feeling expression, a RAM (random access memory) 212, a ROM (read-only memory) 213, and an external storage device 214, such as a hard disc drive, is an independent driven type information processing device capable of self-complete processing within a module.

This thinking control module 200 determines the current feeling or intention of the robot apparatus 60, responsive to stimuli from an exterior side, such as image data entered from an image inputting device 251 or speech data entered from a speech inputting device 252. The image inputting device 251 is provided with a plural number of CCD (charge-coupled device) cameras, for example, while the speech inputting device 252 is provided with a plural number of microphones.

The thinking control module 200 issues commands to the motion control module 300 to carry out a movement or a sequence of actions, which is based on the intention decision, that is, movements of the four limbs.

The motion control module 300, made up by a CPU 311 controlling the whole-body concerted movement of the robot apparatus 60, a RAM 312, a ROM 313, and an external storage device 314, such as a hard disc drive, is an independent driven type information processing device capable of self-complete processing within a module. The external storage device 314 is able to store a walking pattern, calculated off-line, a targeted ZMP trajectory and other action schedule. The ZMP means a point on the floor surface in which the moment by the force of reaction from the floor on which walks the robot apparatus becomes zero. The ZMP trajectory means the trajectory along which the ZMP travels during the period of walking movement of the robot apparatus 60. Meanwhile, the ZMP and use of the ZMP in the stability discrimination standard of the walking robot are explained in Miomir Vukobratovic, "Legged Locomotion Robots" (translated by Ichiro KATO et al., "Walking Robot and Artificial Leg", issued by NIKKAN KOGYO SHIMBUN-SHA.

To the motion control module 300, there are connected a variety of devices, such as the actuator 350 for realizing the degrees of freedom of the joints distributed to the whole body of the robot apparatus 60, shown in FIG. 8, a posture sensor 351 for measuring the posture or tilt of the body trunk unit 62, touchdown confirming sensors 352, 353 for detecting the left and right foot soles clearing or contacting the floor, or a power supply control device 354, supervising the power supply, such as a battery, over a bus interface (I/F) 301. The posture sensor 351 is formed e.g. by the combination of an acceleration sensor and a gyro sensor, while the touchdown confirming sensors 352, 353 are formed by proximity sensors or micro-switches.

The thinking control module 200 and the motion control module 300 are formed on a common platform and are interconnected over bus interfaces 201, 301.

The motion control module 300 controls the whole-body concerted movement by each actuator 350 for realization of the movements commanded by the thinking control module 200. That is, the CPU 311 takes out from the external storage device 314 the movement pattern corresponding to the action commanded by the thinking control module 200, or internally generates a movement pattern. The CPU 311 sets foot movements, ZMP trajectory, body trunk movement, upper limb movement, horizontal movement and the height of the waist part, in accordance with the designated movement pattern, while transferring command values, instructing the movement in keeping with the setting contents, to each actuator 350.

The CPU 311 also detects the posture or the tilt of the body trunk unit 62 of the robot apparatus 60, by an output signal of the posture sensor 351, while detecting whether the left and right leg units 65R/L are in the flight state or in the stance state, from the output signals of the touchdown confirming sensors 352, 353, in order to perform adaptive control of the whole-body concerted movement of the robot apparatus 60.

The CPU 311 controls the posture or the movement of the robot apparatus 60 so that the ZMP position is directed at all time towards the center of the ZMP stable area.

The motion control module 300 is adapted to return the information on what is the extent of the action achieved in keeping with the intention determined by the thinking control module 200, that is, the status of the processing, to the thinking control module 200.

In this manner, the robot apparatus 60 is able to verify the own status and the surrounding status, based on the control program, in order to act autonomously.

In the present robot apparatus 60, the program (inclusive of data), which has implemented the aforementioned singing voice synthesizing function, is placed in e.g. the ROM 213 of the thinking control module 200. In this case, the singing voice synthesizing program is run by the CPU 211 of the thinking control module 200.

By incorporating the singing voice synthesizing function in the robot apparatus, the ability of expression of a robot singing to the accompaniment is newly acquired, with the result that the entertainment properties of the robot are enhanced to provide for more intimate relationship with the human beings.

The present invention is not limited to the above-described embodiments, and may be subject to various modifications without departing from its scope.

For example, although the singing voice information, usable for the singing voice generating unit 7, corresponding to the singing voice synthesizing unit and the waveform generating unit, usable in the speech synthesizing method and apparatus as described in the specification and the drawings of the Japanese Patent Application No. 2002-73385, previously proposed by the present Assignee, is disclosed herein, it is possible to use various other singing voice generating units. In this case, it is of course sufficient that the singing voice information, containing the information needed for generating the singing voice by a variety of singing voice generating units, is generated from the performance data. Moreover, the performance data may any suitable data of a variety of standards, without being limited to the MIDI data.

What is claimed is:

1. A method for synthesizing the singing voice comprising:

an analyzing step of analyzing performance data forming a musical composition as a musical information of a pitch a duration and a lyric;

a singing voice generating step of generating the singing voice through a speech synthesizer based on the music information analyzed; and a key changing step of changing the key of the musical composition in generating said singing voice;

said key changing step changing the key of said performance data, at the time of generation of the singing voice, so that said singing voice will be comprised within the sound range reproducible by said speech synthesizer.

2. The method for synthesizing the singing voice according to claim 1, wherein said performance data is performance data of a MIDI file.

3. The method for synthesizing the singing voice according to claim 1, wherein said key changing step in changing the key of said musical composition adjusts the key of said musical composition so that a highlight portion of said musical composition will be optimized as the sound range for said speech synthesizer.

4. The method for synthesizing the singing voice according to claim 1, wherein said key changing step in changing the key of said musical composition deems that a portion in said performance data where the same phrase appears a plural number of times is a highlight to detect said highlight portion and adjusts the key of said musical composition so that the highlight portion as detected will be optimized as the sound range for said speech synthesizer.

5. The method for synthesizing the singing voice according to claim 1, wherein the highlight portion in said musical composition is commanded by an operator and wherein the key of said musical composition is adjusted so that said highlight portion commanded by said operator will be optimized as the sound range for said speech synthesizer.

6. The method for synthesizing the singing voice according to claim 1, wherein said key changing step changes said key based on the sound range data indicating a sound range that can be synthesized by said speech synthesizer.

7. The method for synthesizing the singing voice according to claim 6, wherein said sound range data is commanded by an operator.

8. The method for synthesizing the singing voice according to claim 6, wherein said sound range data is provided for respective voice sorts of said speech synthesizer.

9. The method for synthesizing the singing voice according to claim 1, wherein said key changing step changes said key based on best sound range data indicating the sound range in which said speech synthesizer is able to synthesize the singing voice with the finest voice.

10. The method for synthesizing the singing voice according to claim 1, wherein, when the sound range of the musical composition has exceeded said sound range data as the singing sound, said speech synthesizer performs the processing of raising or lowering the sound range exceeding sound by one octave, in said key changing step, so that the sound range of said musical composition will be comprised within said sound range.

11. The method for synthesizing the singing voice according to claim 1, wherein, when the sound range of the musical composition has exceeded said sound range data as the singing sound, said speech synthesizer does not adjust the sound scale.

12. The method for synthesizing the singing voice according to claim 9, wherein said best sound range data is commanded by an operator.

13. The method for synthesizing the singing voice according to claim 1, wherein, in said key changing step, an operator instructs whether or not said key is to be changed.

14. An apparatus for synthesizing the singing voice comprising:

analyzing means for analyzing performance data forming a musical composition as the musical information of the pitch, duration and lyric;

singing voice generating means for generating the singing voice through a speech synthesizer based on the music information analyzed; and key changing means for changing the key of the musical composition in generating said singing voice;

said key changing means changing the key of said performance data, at the time of generation of the singing voice, so that said singing voice will be comprised within the sound range reproducible by said speech synthesizer.

15. The apparatus for synthesizing the singing voice according to claim 14, wherein said performance data is performance data of a MIDI file.

16. The apparatus for synthesizing the singing voice according to claim 14, wherein said key changing means adjusts the key of said musical composition so that a highlight portion of said musical composition will be optimized as the sound range for said speech synthesizer.

17. The apparatus for synthesizing the singing voice according to claim 14, wherein said key changing means changes said key based on the sound range data indicating a sound range that can be synthesized by said speech synthesizer.

18. The apparatus for synthesizing the singing voice according to claim 14, wherein said key changing means changes said key based on best sound range data indicating the sound range in which said speech synthesizer is able to synthesize the singing voice with the finest voice.

19. A computer-readable recording medium having recorded thereon a program with instructions that when executed by a processor perform steps comprising:

an analyzing step of analyzing performance data forming a musical composition as the musical information of the pitch, duration and lyric;

a singing voice generating step of generating the singing voice through a speech synthesizer based on the music information analyzed; and a key changing step of changing the key of the musical composition in generating said singing voice;

said key changing step changing the key of said performance data, at the time of generation of the singing voice, so that said singing voice will be comprised within the sound range reproducible by said speech synthesizer.

20. The recording medium according to claim 19, wherein said performance data is performance data of a MIDI file.

21. An autonomous robot apparatus comprising:

analyzing means for analyzing input performance data forming a musical composition as the musical information of the pitch, duration and lyric;

singing voice generating means for generating the singing voice through a speech synthesizer based on the music information analyzed; and key changing means for changing the key of the musical composition in generating said singing voice;

said key changing means changing the key of said performance data, at the time of generation of the singing voice, so that said singing voice will be comprised within the sound range reproducible by said speech synthesizer.

22. The robot apparatus according to claim 21, wherein said performance data is performance data of a MIDI file.

* * * * *

UNITED STATES PATENT AND TRADEMARK OFFICE

CERTIFICATE OF CORRECTION

PATENT NO. : 7,241,947 B2
APPLICATION NO. : 10/801682
DATED : July 10, 2007
INVENTOR(S) : Kenichiro Kobayashi It is certified that error appears in the above-identified patent and that said Letters Patent is hereby corrected as shown below:

Title page, Column 2, Item (57) Abstract, line 11, please change “signing” to --singing--.

Column 14, line 21, please insert a --,-- after “pitch”.

Signed and Sealed this

First Day of July, 2008

JON W. DUDAS
*Director of the United States Patent and Trademark Office*